US006643851B1

(12) United States Patent
Janes

(10) Patent No.: US 6,643,851 B1
(45) Date of Patent: Nov. 11, 2003

(54) EASILY REMOVABLE AND REPLACEABLE TOILET SEAT AND LID

(76) Inventor: Timothy T. Janes, 4921 Marine Ave., Lawndale, CA (US) 90260

( * ) Notice: Subject to any disclaimer, the term of this patent is extended or adjusted under 35 U.S.C. 154(b) by 0 days.

(21) Appl. No.: 10/150,280

(22) Filed: May 16, 2002

(51) Int. Cl.[7] ..... A47K 13/12
(52) U.S. Cl. ..... 4/236; 4/234; 4/240
(58) Field of Search ..... 4/234, 236, 240; 411/41, 46, 48, 60.1

(56) References Cited

U.S. PATENT DOCUMENTS 3,063,063 A * 11/1962 Brooks ..... 4/236
3,613,130 A * 10/1971 Sansone ..... 4/240
4,319,365 A * 3/1982 Bemis et al. ..... 4/236
5,457,824 A * 10/1995 Reed ..... 4/234
6,101,640 A * 8/2000 Brewer et al. ..... 4/236

* cited by examiner

*Primary Examiner*—Tuan N. Nguyen
(74) *Attorney, Agent, or Firm*—Edgar W. Averill, Jr.

(57) ABSTRACT

An easily removable and replaceable toilet seat lid and hinge assembly. When it becomes necessary to clean the top of the toilet, toilet seat, and lid, the toilet seat and lid may be readily removed without having to remove the bolts which hold the seat on the toilet. Instead, male and female clip members hold the seat to the toilet and may be readily snapped in and out of attachment to remove or replace the toilet seat.

4 Claims, 4 Drawing Sheets

FIG. 1
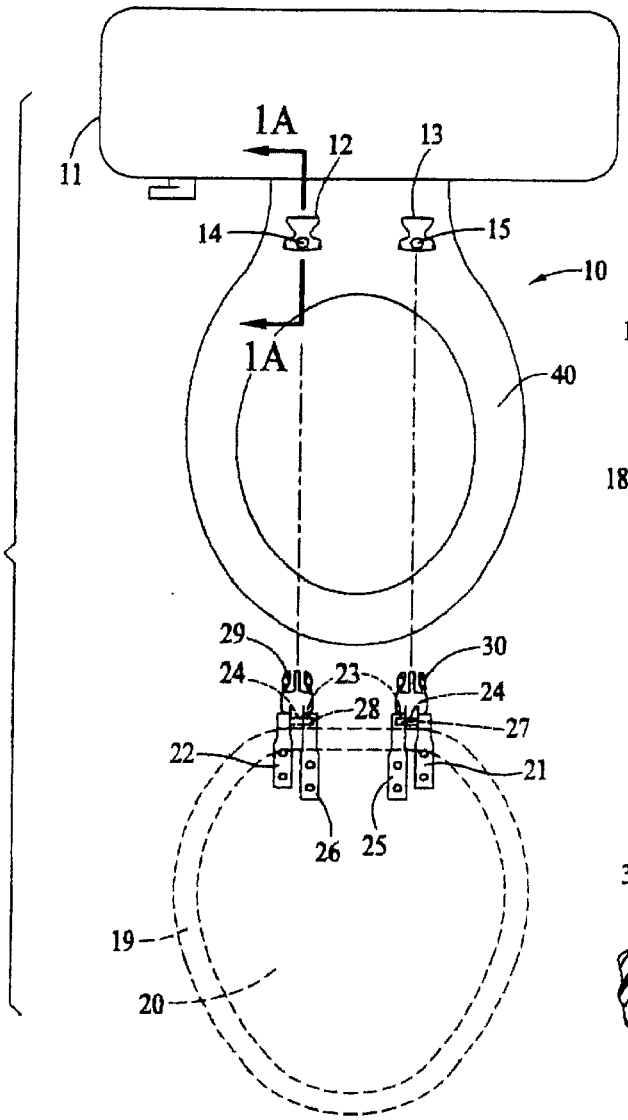
FIG. 1A
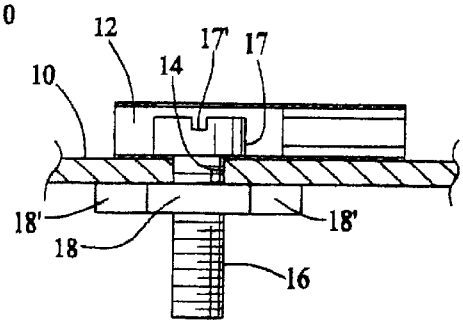
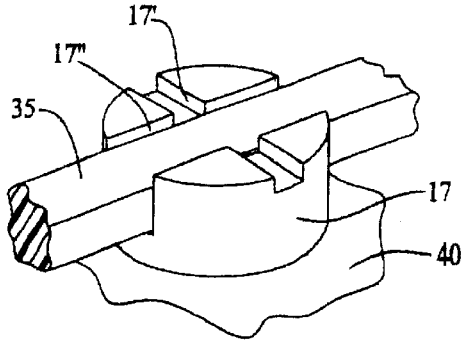
FIG. 1B

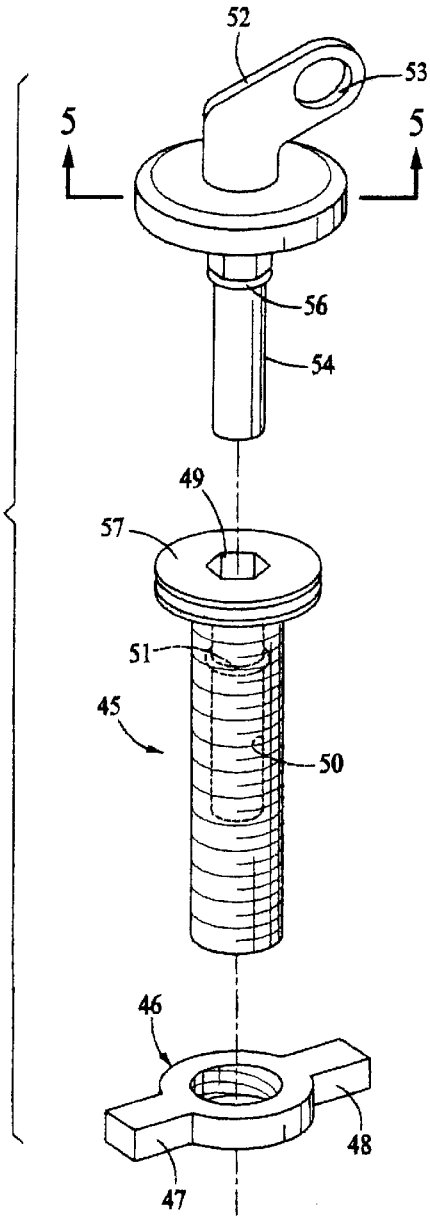
FIG. 4
FIG. 5
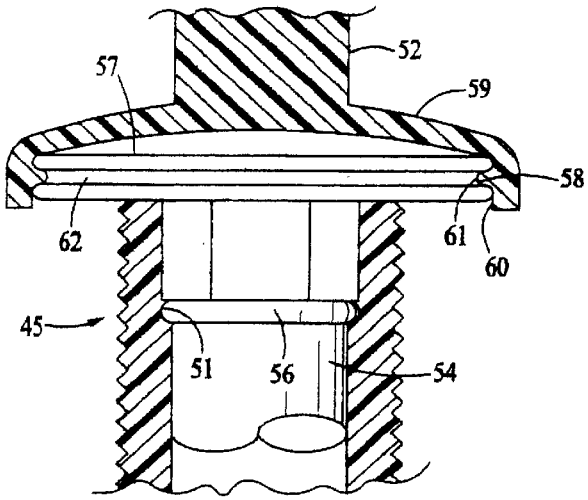
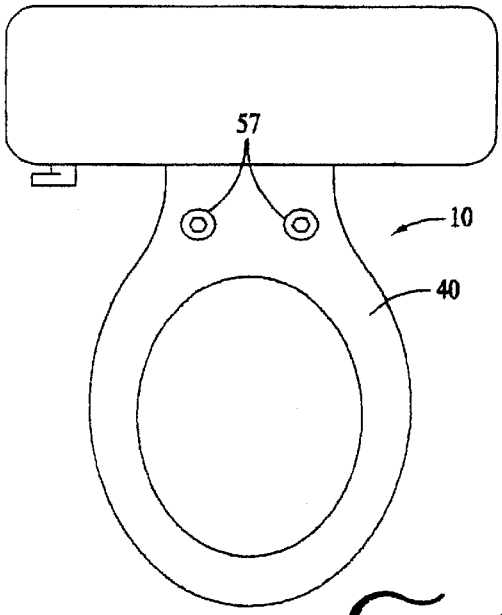
FIG. 6

EASILY REMOVABLE AND REPLACEABLE TOILET SEAT AND LID

BACKGROUND OF THE INVENTION

The field of the invention is toilet seats and the invention relates more particularly to toilet seats that are configured to facilitate the cleaning of the top surface of the toilet bowl and basic cleaning of the seat and lid by rinsing under hot water.

BRIEF SUMMARY OF THE INVENTION

It is an object of the present invention to provide a toilet seat, lid, and hinge assembly which may be easily removed from the top of a toilet bowl to facilitate the cleaning of the top of the toilet bowl.

The present invention is for an easily removable and replaceable toilet seat, lid, and hinge assembly attachable to a toilet. Such toilet seats are conventionally held to the top of the toilet bowl by a pair of nuts and bolts. While the nuts and bolts may be removed, this is impractical for cleaning purposes because it is too time consuming and requires tools. The toilet seat, lid, and hinge assembly are attached to the toilet bowl by a pair of male and female clips which are snapped together. The female clips are held by a pair of bolts secured by a pair of nuts in the conventional vertical holes located on the top of the toilet bowl. A pair of male clip members are part of the hinge assembly which attaches to the toilet seat and lid. When it is desired to remove the toilet seat, lid, and hinge assembly (which stays together as a unit), the male and female clip members are disconnected and the toilet seat lifted away from the toilet bowl. All that is left is a pair of female clip halves around which cleaning may be readily accomplished. The seat and lid can easily be cleaned by rinsing under hot water. Then the male clip members may be reinserted into the female clip members and snapped together to secure the toilet seat, lid, and hinge assembly back on the toilet bowl.

One male and female clip assembly includes a pair of flexible fork legs on the male half and a pair of sideways oriented openings on the female half. When pressed together, the fork legs move outwardly into the openings in the sides of the female clip member. An alternate configuration utilizes a male clip body having a raised flexible tab which has a locking ridge at its rear end. The female clip half has an opening in its upper surface and the forward end of the opening terminates in a ridge against which the male's locking ridge of the raised flexible tab abuts. When it is desired to remove the male clip body, the raised flexible tab is pressed downwardly so that its locking ridge falls below the forward edge of the opening in the female half.

Another approach is to provide a vertical passageway in the bolts and a male pin which may be snapped into the vertical openings. The male pin supports a post attachment member which holds the hinge assembly with its toilet seat and lid. This is removed by lifting directly upwardly to pull the post out of the passageway in the bolts.

BRIEF DESCRIPTION OF THE DRAWINGS

FIG. 1 is a top view showing a toilet bowl and tank and a removed toilet seat, lid, and hinge assembly.

FIG. 1A is an enlarged view taken along line 1A—1A of FIG. 1.

FIG. 1B is an enlarged perspective view of the bolt head and center stabilizing leg of FIG. 1A.

FIG. 4 is an exploded perspective view of an alternate embodiment of the clip assembly of FIG. 1.

FIG. 5 is an enlarged cross-sectional view taken along line 5—5 of FIG. 4.

FIG. 6 is a top view of the toilet bowl utilizing the attachment means shown in FIG. 4 of the drawings.

DESCRIPTION OF THE PREFERRED EMBODIMENTS

Figure 2:
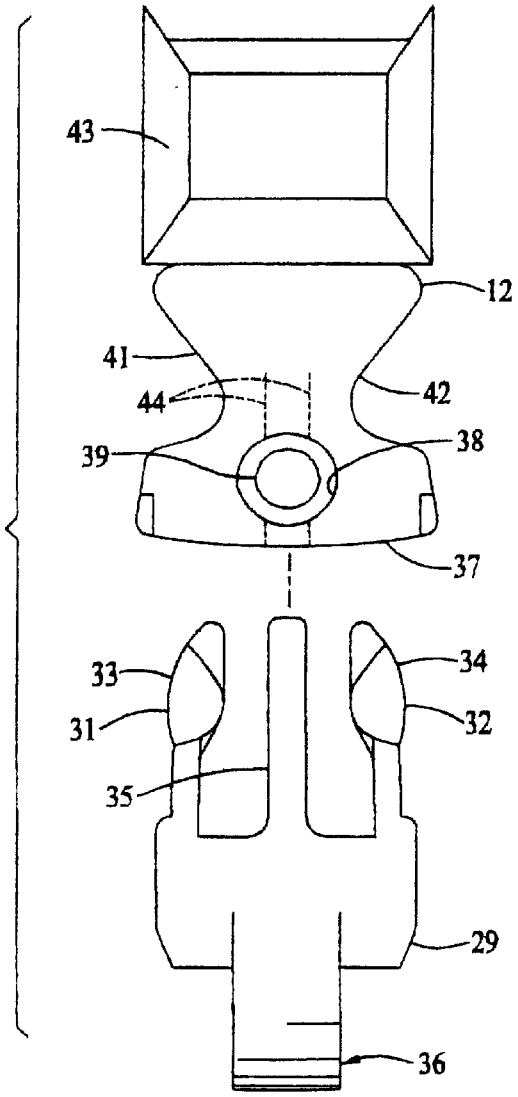
FIG. 2 is an exploded view of the male and female clip members of the assembly of FIG. 1 in a disconnected configuration.

A toilet bowl 10 and tank 11 are shown in top view in FIG. 1 of the drawings. The bowl and tank are conventional, except that a pair of female clip members 12 and 13 are secured over the conventional space to vertical holes 14 and 15. The bolt is shown in FIG. 1A and indicated by reference character 16 and the bolt head with grooves is indicated by reference character 17. Bolt head 17 has a large stabilizing groove 17" and a screwdriver slot 17'. The interlocking of the stabilizing leg 35 in stabilizing groove 17" prevents the bolt head from turning and loosening. A nut 18 with a pair of limiting tabs 18' holds the bolt 16 to the toilet bowl 10 while the limiting tabs 18' prevent the turning of the nut any significant amount so it holds the bolt 16 to the toilet bowl 10.

A pair of hinge post members 21 and 22 are attached or are integral with seat 19. Each hinge post member has an integral post 23 and 24.

A pair of end sleeves 25 and 26 are attached to the toilet lid and have an opening 27 and 28 into which posts 23 and 24, respectively, fit.

Between members 21 and 25, post 23 is exposed and a male clip member 30 is pivotally attached. Similarly, clip member 29 is pivotally attached on horizontal post 24.

Figure 3:
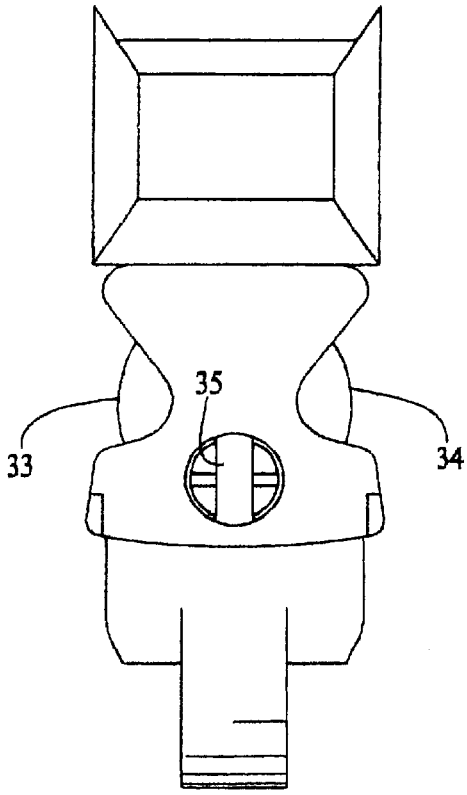
FIG. 3 is a connected version thereof.

The details of construction of the male and female clip members is shown best in FIGS. 2 and 3 of the drawings. Since both clip members are identical, only one will be described. The male portion 29 has a left flexible fork leg 31 and a right flexible fork leg 32. Each fork leg has an outwardly extending protrusion 33 and 34. A center stabilizing leg 35 may be added to provide further structural integrity and to keep bolt 17 from coming loose by the presence of stabilizing leg 35 in stabilizing groove 17" when the male and female portions are locked together. Male portion 29 has a body which includes a through hole 36 which passes over horizontal post 24.

The female portion 12 of a clip has an entrance 37 large enough to accept male portion 29. A larger hole 38 is formed above entrance 37 for the insertion of bolt 16 and a smaller hole 39 is formed below entrance 37 to secure the head 17 of bolt 16. This secures the female portion 12 to the top of toilet bowl 10. Toilet bowl 10 has a flat upper surface indicated by reference character 40 in FIG. 1.

A pair of openings 41 and 42 are formed in the sides of the female portion 12 and the protrusions 33 and 34 snap outwardly into openings 41 and 42, securing male portion 29 to female portion 12. A folding cap 43 may be added to cover the top of female portion 12. A track 44 is formed between openings 41 and 42 for the passage of center stabilizing leg 35.

The assembled clip is shown in top view in FIG. 3. It may be released by pressing inwardly on protrusions 33 and 34 while pulling outwardly on male portion 29. This leaves only the female portions 12 on the flat upper surface 40 of toilet bowl 10, thereby permitting it to be very easily cleaned.

Another method of removably securing a toilet seat, lid, and hinge assembly is shown in FIGS. 4, 5, and 6. A bolt 45 is secured to the toilet bowl by a nut 46. Nut 46 may be of conventional construction, but the preferred construction has a pair of limiting tabs 47 and 48 which prevent the turning of the nut when bolt 45 is turned. Bolt 45 has a hexagonal opening 49 which may be utilized with an Allen wrench to tighten bolt 45 and nut 46 against toilet bowl 10. Below the hexagonal opening 49 is a cylindrical opening 50 which has an inwardly facing groove 51.

A post attachment member 52 is shown at the top of FIG. 4 and has a hole 53 into which a hinge post may be inserted. Post attachment member 52 is secured to post 54 as shown in FIG. 5. Post 54 has a ring 56 which snaps into groove 51. In FIG. 5, bolt head 57 has an outer peripheral groove 58. Post attachment member 52 has an outwardly extending flange 59. Flange 59 has a downwardly extending ring 60 which has an inwardly extending ridge 61. Ridge 61 snaps into groove 62 on the outer edge of bolt edge 57. In use, post 54 is inserted through hexagonal opening 49 and into passageway 50. It is pressed downwardly until ring 56 snaps into groove 51. This secures the toilet seat, lid, and hinge assembly to the toilet bowl. The seat, lid, and hinge assembly are not shown since they may be clearly understood by viewing FIG. 1 of the drawings.

When it is desired to remove the toilet seat, lid, and hinge assembly, one merely lifts up with sufficient force so that ring 56 snaps out of groove 51 and ridge 61 releases from groove 58. This leaves only two bolt heads 57 protruding the flat upper surface 40 of toilet bowl 10. Thus, the wiping off of the toilet surface is very easy, after which the toilet seat, lid, and hinge assembly is snapped back into place.

Figure 7:
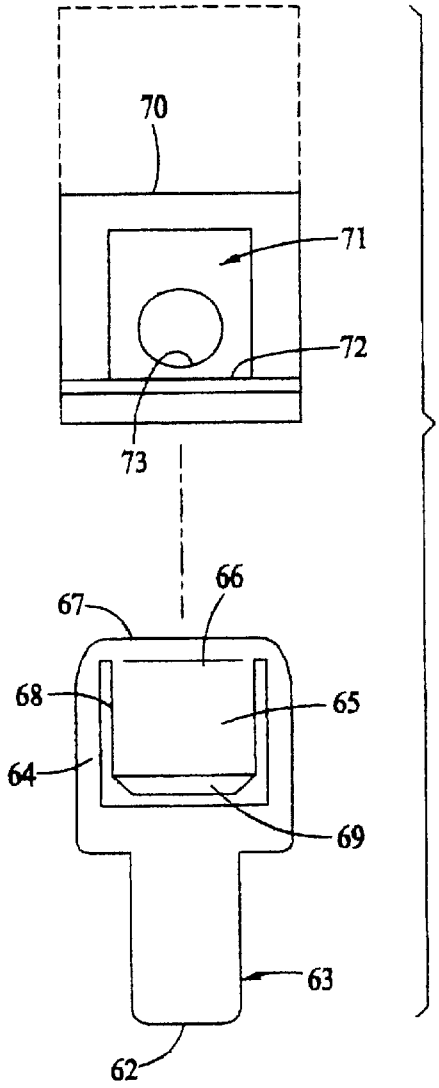
FIG. 7 is an exploded top view of an alternate configuration of a male and female clip pair of the assembly of FIG. 1.
Figure 8:
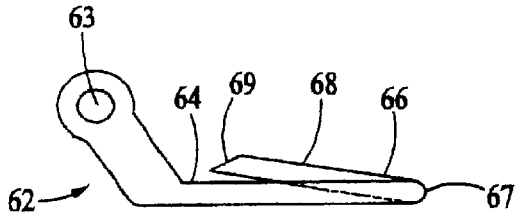
FIG. 8 is a side view of the male portion of the clip assembly of FIG. 7.

Yet another male and female type of connectors are shown in FIGS. 7 and 8 of the drawings. The male portion is indicated generally by reference character 62. Male portion 62 has an opening 63 for the passage of post 23 or 24. The male clip body 64 has a raised flexible tab 65 which has a biased hinge 66 near the front edge 67 of male portion 62. An opening 68 surrounds raised flexible tab 65 so that the locking ridge 69 on flexible tab 65 may raise above clip body 64, as shown best in FIG. 8.

The female portion 70 has a rectangular opening 71. Opening 71 has a forward edge 72 which abuts locking ridge 69 when the male and female portions are snapped together. An opening 73 is formed for a conventional bolt to hold the female portion 70 in place.

Thus, a very easily operated assembly is provided which permits the rapid removal and replacement of the toilet seat, lid, and hinge assembly for cleaning. Typically, the parts would be fabricated from a polymer. A composite polymer can provide sufficient strength for securely holding the parts together while still providing sufficient flexibility for the assembly and disassembly.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An easily removable and replaceable toilet seat, lid, and hinge assembly attachable to a toilet of the type having a flat upper surface which supports a toilet tank, a toilet seat and lid assembly, said toilet seat, lid and hinge assembly being held against the flat upper surface by attachment means including a pair of horizontal posts affixed to said toilet seat, lid and hinge assembly and said horizontal posts each supporting a post attachment member having a through hole surrounding said horizontal post and said each post attachment member being supported by one of two conventional spaced vertical holes positioned in front of the toilet tank, said assembly comprising:

a pair of bolts secured by nuts to said conventional vertical holes, each of said pair of bolts having a female clip half secured thereto;

a first and a second male clip member each being secured to said post attachment member and removable attachment means between said female clips and said first and second male clip members whereby said toilet seat and lid may be removed from the toilet by disconnecting said male clip members from said female clip members and reconnected by inserting the male clip members into the female clip members.

2. The assembly of claim 1 wherein said male clip members comprise a clip body having a left flexible fork leg and a right flexible fork leg, each leg having a raised outer protrusion and said female clip halves each have a forward oriented opening and two side openings, said forward oriented opening being large enough to accept a male clip member and said two side openings being surrounded by a clip passageway of a width sufficiently narrow to cause said fork legs inwardly toward one another and said side openings being large enough to accept said raised outer protrusions whereby said toilet seat, lid, and hinge assembly may be snapped onto the toilet and may be removed by pressing said outer protrusions together without having to remove the pair of bolts.

3. The assembly of claim 2 wherein said male clip members further include a central stabilizing leg positioned between said left and right flexible fork legs and each of said female clip halves has a recess to accept a stabilizing leg.

4. The assembly of claim 1 wherein said male clip members comprise a clip body having a raised flexible tab having a biased hinge near a front edge thereof and said raised flexible tab being angled upwardly from said biased hinge and terminating in a locking ridge flexibly positioned above said clip body away from said biased hinge and said female clip halves each have a forward oriented opening said forward oriented opening being large enough to accept a clip body and said female clip halves having an opening in a top portion thereof, said opening including a forward edge large enough to contact said locking ridge of said locking plate whereby said toilet seat, lid, and hinge assembly may be snapped onto the toilet and may be removed by pressing down on said raised flexible tab so that the locking ridge moves below said forward edge of said female clip member separating the male and female clip members and allowing the removal of the toilet seat, lid, and hinge assembly without having to remove the pair of bolts.

* * * * *